US010499775B1

(12) United States Patent
Ramos

(10) Patent No.: US 10,499,775 B1
(45) Date of Patent: Dec. 10, 2019

(54) TOILET SEAT STABILIZER AND DEODORIZER

(71) Applicant: Carli A. Ramos, Roseville, CA (US)

(72) Inventor: Carli A. Ramos, Roseville, CA (US)

( * ) Notice: Subject to any disclaimer, the term of this patent is extended or adjusted under 35 U.S.C. 154(b) by 0 days.

(21) Appl. No.: 16/179,943

(22) Filed: Nov. 4, 2018

Related U.S. Application Data

(60) Provisional application No. 62/581,534, filed on Nov. 3, 2017.

(51) Int. Cl.
*A47K 13/30* (2006.01)
*A47K 13/26* (2006.01)

(52) U.S. Cl.
CPC ..... *A47K 13/30* (2013.01); *A47K 13/26* (2013.01)

(58) Field of Classification Search
CPC ..... A47K 13/30; A47K 13/26; A47K 13/24; A47K 13/242
USPC ..... 4/237, 233
See application file for complete search history.

(56) References Cited

U.S. PATENT DOCUMENTS 4,747,167 A * 5/1988 Adams ..... A47K 13/02 4/234
4,893,360 A * 1/1990 Wofford ..... A47K 13/26 297/188.1
4,970,730 A 11/1990 Stain
5,058,215 A 10/1991 Sims
5,091,999 A * 3/1992 Turner, Jr. ..... A47K 13/00 4/237
5,212,840 A * 5/1993 Caldwell ..... A47K 13/00 4/237
5,361,425 A * 11/1994 Armanno, Sr. ..... A47K 13/04 16/86 A
6,641,096 B2 11/2003 Johansson et al.
7,536,732 B1 * 5/2009 Dunlap ..... A47K 13/04 4/237
2010/0017947 A1 * 1/2010 Hobbs ..... A47K 13/04 4/237
2013/0291295 A1 * 11/2013 Falzarano ..... A47K 13/04 4/248
2014/0026304 A1 * 1/2014 Ilvento ..... A47K 13/24 4/237

* cited by examiner

*Primary Examiner* — Benjamin R Shaw
(74) *Attorney, Agent, or Firm* — Nelson T. Rivera

(57) ABSTRACT

A deodorizing toilet seat stabilizing device configured to attach to the rim of a toilet bowl to prevent the toilet seat from sliding thereon. The device is comprised of a unitary rigid member having a bottom side and at least one side wall defining an encasing slot adapted for receiving a toilet seat bumper. The encasing slot is also adapted to prevent the toilet seat from sliding back and forth on the toilet; and attachment material for securely attaching the bottom side of the device to the rim of the toilet bowl. The attachment material is comprised of a scented adhesive material, the adhesive material is comprised of a stretch releasing adhesive tape strip having an adhesive portion and a non-adhesive pull tab, wherein the attached device can be removed from the rim of the toilet bowl by pulling on the non-adhesive pull tab.

14 Claims, 12 Drawing Sheets

TOILET SEAT STABILIZER AND DEODORIZER

PRIORITY CLAIM

This non-provisional application claims priority to Provisional Patent Application Ser. No. 62/581,531, entitled "Toilet Seat Stabilizer and Deodorizer", filed on Nov. 3, 2017.

TECHNICAL FIELD

The present invention relates to attachments and accessories for toilets, specifically toilet seats, and more particularly without limitation, relating to a deodorizing device attachable to a toilet bowl rim for slide prevention of the toilet seat relative to, and in cooperation with, one or more toilet seat stabilizers.

BACKGROUND OF THE INVENTION

Toilet seats take an enormous amount of physical abuse in the form of weight applied to them in an uneven manner when they are used, and also when they are abruptly released and dropped on the rim of the toilet bowl. This physical abuse is exacerbated by the manner in which toilet seats are designed and mounted to the rear of the toilet bowl. For example, conventional toilet seats hinged to the rear of the toilet bowl are supported in their lowered positions on the rim of the toilet bowl by at least two bumpers secured to the underside of toilet seat, typically supported on the front underside of the seat. Such bumpers are not effective, however, to prevent horizontal shift of the toilet seat under load from its position in alignment with the toilet bowl opening.

In any case, the physically abuse of toilet seats can also be exacerbated when young children or even adults stand on either the toilet seat and/or the toilet lid when trying to grab items placed behind the toilet and not within their reach. For instance, children are known to stand on toilet seats/lids when trying to grab items placed on a shelf located directly behind a toilet or when reaching to use a sink located next to the toilet in order to wash their hands. Unfortunately, over time this load causes the toilet seat to become horizontally unstable causing the toilet seat to shift to the left or to the right when in use.

There are also new devices used by individuals such as the SQUATTY POTTY® which provides a foot footrest that allows a user to stand on while he or she is squatting on a toilet seat to stimulate the evacuation reflex and to elevate the user in a position so he or she can squat while on a Western-style toilet. While a user is sitting on the toilet seat, he or she can also move their feet back and forth over massage bumps disposed on the foot members for a massage. When a user is ready to squat, the foot members can be locked into place with locking clips so that the user can squat over the toilet. Unfortunately, over time this type of uneven weight distribution can cause the toilet seat to become horizontally unstable causing the toilet seat to shift to the left or to the right when in use.

Accordingly, there clearly exists a need for a device that can be attached to the top surface of a toilet bowl rim for preventing a toilet seat from sliding back and forth for maintaining the position of the toilet seat relative to the rim of the toilet bowl, thereby diminishing wear, abuse, and neglect, and thus the need for repair and replacement.

BRIEF SUMMARY OF THE INVENTION

The present invention pertains generally to a toilet seat stabilizing device.

The present invention also relates generally to a deodorizing toilet seat stabilizing device attachable to a toilet bowl rim for horizontal slide protection of a toilet seat relative to the rim of the toilet bowl that works in cooperation with one or more toilet seat bumpers.

The present invention includes an attachment material or substance for securely attaching the bottom side of the toilet seat stabilizing device to the rim of the toilet bowl.

The present invention additionally includes scented attachment material or a substance for securely attaching the bottom side of the toilet stabilizing device to the rim of the toilet bowl and for emitting a scent to an area, namely a bathroom.

The present invention further includes an attachment material that is comprised of an adhesive material. The adhesive portion will be applied to the bottom side of the device and to the rim of the toilet bowel for attaching said device to the rim of the toilet bowl.

The present invention also includes an adhesive material comprised of a stretch releasing adhesive tape strip having an adhesive portion and a non-adhesive pull tab.

A further aspect of the present invention is to provide a toilet seat stabilizing device that can be removed from the rim of the toilet bowl by pulling on the non-adhesive pull tab.

An additional aspect of the present invention is to provide a toilet seat stabilizer that can be quickly and easily installed to a toilet bowl rim for stabilizing the toilet seat.

In one embodiment, an adhesive material is comprised of a scented stretch releasing adhesive tape strip having an adhesive portion and a non-adhesive pull tab.

Consequently, for a better understanding of the present invention, its functional advantages and the specific objects attained by its uses, reference should be made to the accompanying drawings, claims and descriptive matter in which there are illustrated preferred embodiments of the invention.

DETAILED DESCRIPTION OF THE INVENTION

Introduction

The following detailed description is of the best currently contemplated modes of carrying out various embodiments of the invention in which said embodiments can be carried out independently and/or in combination. The description is not to be taken in a limiting sense, but is made for at least the purpose of illustrating the general principles of the invention, since the scope of the invention is best defined by the appended claims.

In one embodiment of the present invention, a toilet seat stabilizing device is advantageously comprised of a unitary rigid planar member having a bottom side and having at least one side wall defining an encasing slot adapted for receiving a toilet seat bumper, wherein the encasing slot having the general shape of the toilet seat bumper; the encasing slot further adapted to prevent the toilet seat from sliding back and forth upon the rim of the toilet bowl; and attachment material or substance for securely attaching the bottom side of the device to the rim of the toilet bowl. Optionally, the attachment material or substance is scented for emitting a fragrance to deodorize an area such as a bathroom.

In another embodiment, a method of stabilizing a toilet seat with a toilet seat stabilizing device is provided. The method comprises the steps of: defining an encasing slot adapted for receiving a toilet seat bumper, the encasing slot having the general shape of the toilet seat bumper; joining the encasing slot to the bumper of a toilet with a removable attaching adhesive for alignment of the toilet seat stabilizing device on the rim of a toilet; and attaching the bottom side of the said device to the rim of the toilet bowl with an adhesive material, thereby preventing the toilet seat from sliding back and forth upon the rim of the toilet bowl. Optionally, the method is further comprised of the step of deodorizing a room or bathroom with an attachment material or substance that is scented.

DETAILED DESCRIPTION

It should be understood that the foregoing relates to various embodiments of the present invention which can be carried out independently and/or in combination and that modifications may be made without departing from the spirit and scope of the invention. It should be further understood that the present invention is not limited to the designs mentioned in this application and the equivalent designs in this description, but it is also intended to cover other equivalents now known to those skilled in the art, or those equivalents which may become known to those skilled in the art in the future.

Figure 1:
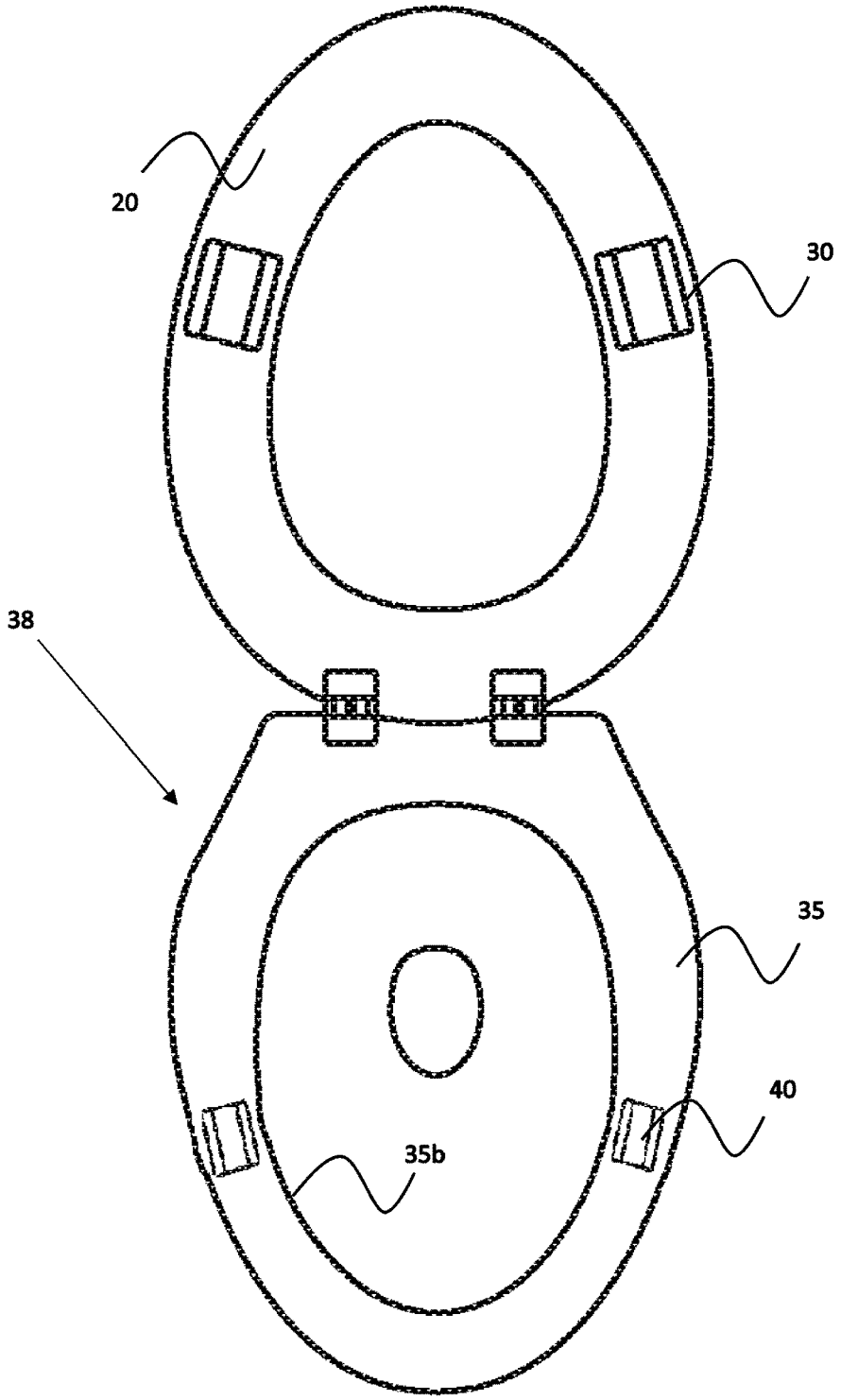
FIG. 1 is a perspective view of one embodiment of the invention showing the toilet seat stabilizing device attached to the rim of a toilet bowl.
Figure 2A:
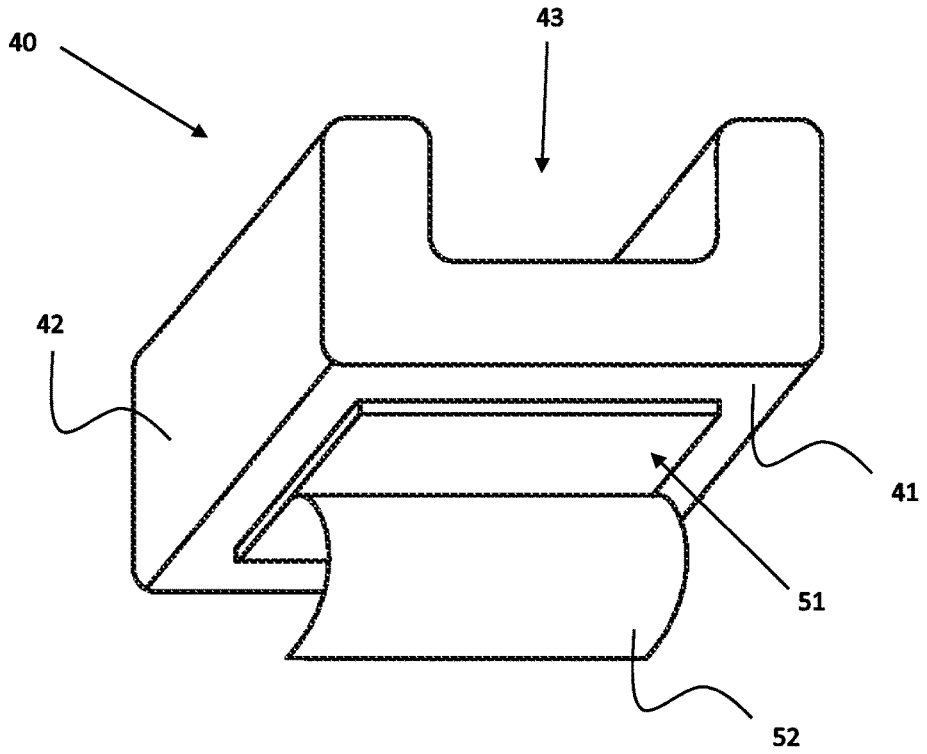
FIG. 2A is a front perspective view of the toilet seat stabilizing device.

Referring now to the drawings, FIG. 1 shows a toilet seat stabilizing device 40 attached to the rim 35 of a toilet bowl 38. The device 40 is comprised of a unitary rigid planar member having a bottom side 41 and having at least one side wall 42 defining an encasing slot 43 adapted for receiving a toilet seat bumper 30 (See also FIG. 2A). The encasing slot 43 will advantageously have the general shape of the toilet seat bumper 30.

Figure 2B:
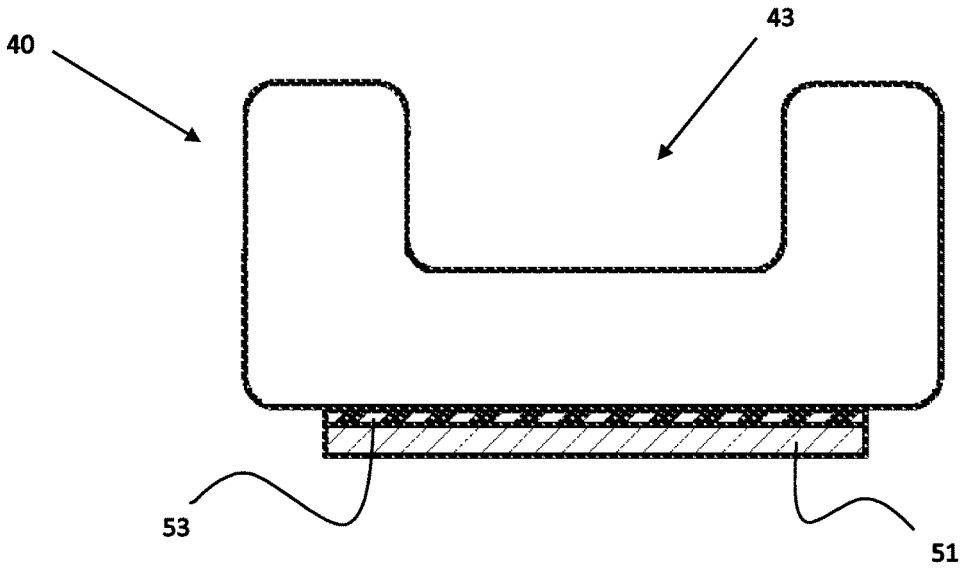
FIG. 2B is another perspective view of the toilet seat stabilizing device.
Figure 3:
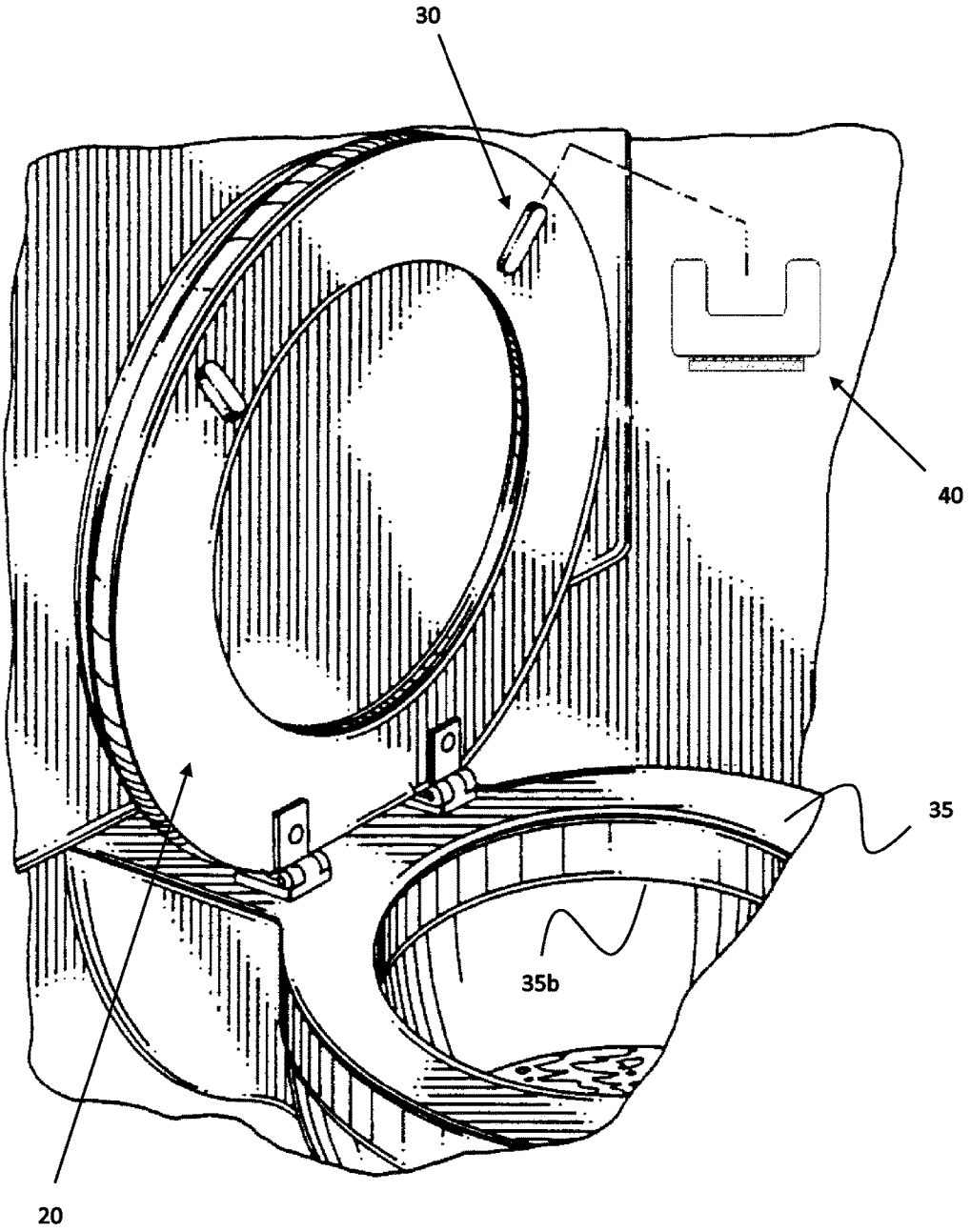
FIG. 3 is perspective view showing how the toilet seat stabilizing device works in cooperation with the bumper of a toilet seat.

In use, the encasing slot 43 is suitably adapted to prevent the toilet seat 20 from sliding back and forth upon the rim 35 of the toilet bowl 38 (see FIGS. 1 and 3). Additionally, there is an attachment material 51 for securely attaching the bottom side 41 of the device 40 to the rim 35 of the toilet bowl 38 (See also FIGS. 1, 2A, 2B and 3). Optionally, the attachment material 51 includes a beneficial scented substance or material 51*s* that is suitably configured to emit a fragrance to an area, namely a bathroom Referring now to FIGS. 2A and 2B, the attachment material 51 of the toilet seat stabilizing device 40 is comprised of an adhesive material 51. The adhesive material 51 is comprised of a stretch releasing adhesive tape strip 50 (See FIGS. 4A and 4B) that has an adhesive portion 51 and a non-adhesive pull tab 53. In another embodiment, the material of the stretch releasing adhesive tape strip 50 is comprised of a beneficial scented substance or material 51*s* suitably configured to emit various aromatic fragrances to an area such as a room or bathroom (See also FIGS. 8A-8D).

Figure 2C:
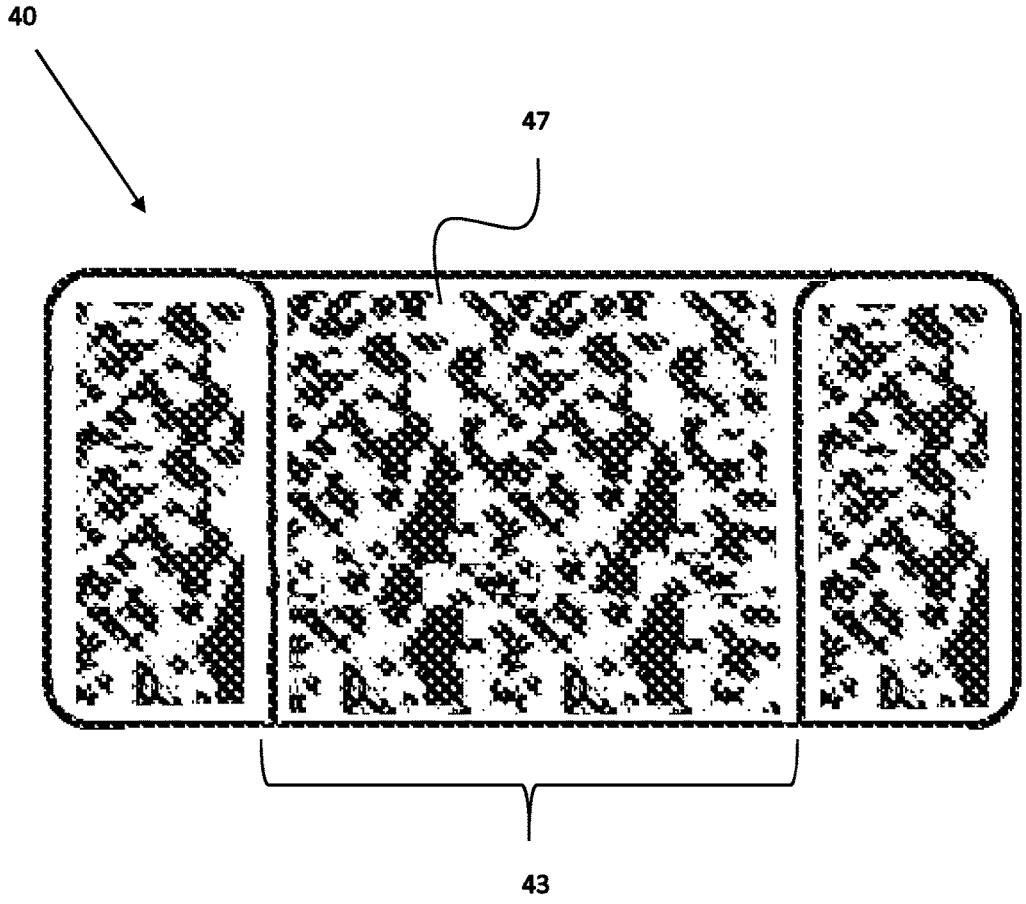
FIG. 2C is a top view of the toilet seat stabilizing device.

FIG. 2C refers to a top view of the toilet seat stabilizing device 40 which is configured to function in cooperation with a bumper 30. The encasing slot 43 of the present invention can include an initial attachment material 47 suitably configured to allow said slot 43 to initially stick to the bumper 30 for easy alignment of said device 40 to the rim 35 of a toilet bowl 38. In another embodiment, the initial attachment material 47 can be advantageously comprised of a double sided quick release adhesive tape 47 and/or an easy release glue type material 47. Once the device 40 has been aligned and fastened to the rim 35, the easy release attachment material 47 can be removed.

Alternatively, the encasing slot 43 is configured to cooperate with a bumper 30 by having a mild or slight interference fit 43*i*. This interference fit 43*i* allows the slot 43 to initially fasten to the bumper 30 while aligning and attaching the slot 43 to the rim 35.

In use, the adhesive portion 51 is applied to the bottom side of the device 40 and to the rim 35 of the toilet bowel 38 for attaching said device to the rim of the toilet bowl. When a user wants to remove the device 40 from the rim 35, said user can remove the device 40 from the rim 35 of the toilet bowl 38 by pulling on the non-adhesive pull tab 53. This feature allows for said device 40 to be replaced for sanitary purposes or to replaced when the adhesive material loses its adhesive properties.

In a further embodiment of the present invention, the device 40 can be comprised of the following material: plastic material, die cast plastic material, molded plastic material, rigid plastic material, and rubber, wherein the material of the plastic is rigid.

Optionally, the attachment material can also be comprised of a screw fastener, a glue type material, a hook and loop type fastener, or a double sided adhesive tape.

In another embodiment, the general shape of the encasing slot is comprised of a square, oval, circle or rectangle or simply the shape of a toilet seat bumper 30.

Figure 4A:
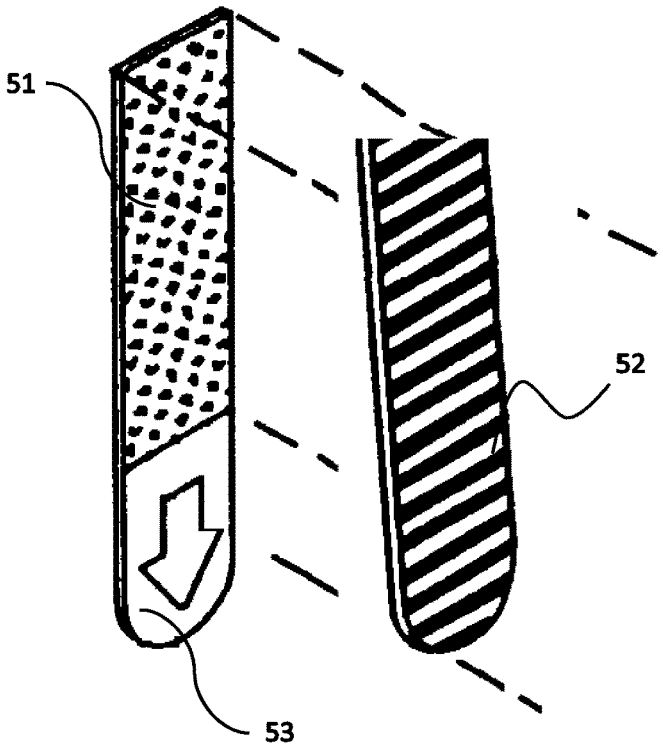
FIG. 4A is a single figure of the stretch releasing adhesive tape having an adhesive portion and a non-adhesive pull tab
Figure 4B:
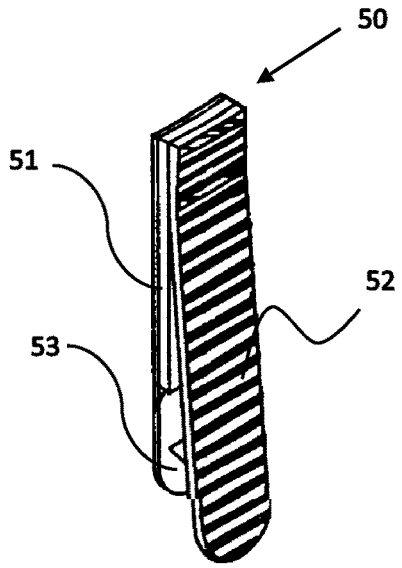
FIG. 4B is another single view of the stretch releasing adhesive tape having an adhesive portion and a non-adhesive pull tab.

Referring now to FIGS. 4A and 4B, the stretch releasing adhesive tape 50 is comprised of an attachment material 51, a non-adhesive pull tab 53 and a removable liner 52 disposed on the front and back side of the tape 50. The material of the stretch releasing adhesive tape strip 50 is advantageously comprised of a beneficial scented substance or material 51*s* that is suitably configured to emit a plurality of desirable scents to an environment such as a restroom (See also FIGS. 4A-4B).

In another embodiment, the stretch releasing adhesive tape strip 50 is comprised of a strip 50 having one side comprised of an adhesive 51 and the other side comprised of scented material 51*s* or the strip 50 is comprised of a double sided scented strip 51/51*s*.

Figure 9A:
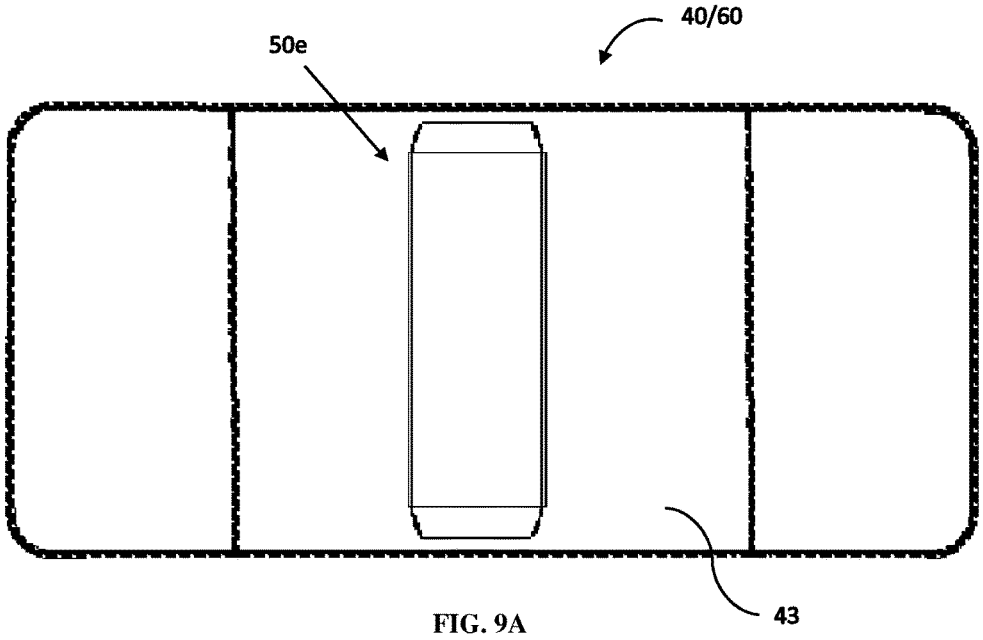
FIG. 9A represents a top portion of the top encasing slot having at least one encasing channel attached thereon.
Figure 9B:
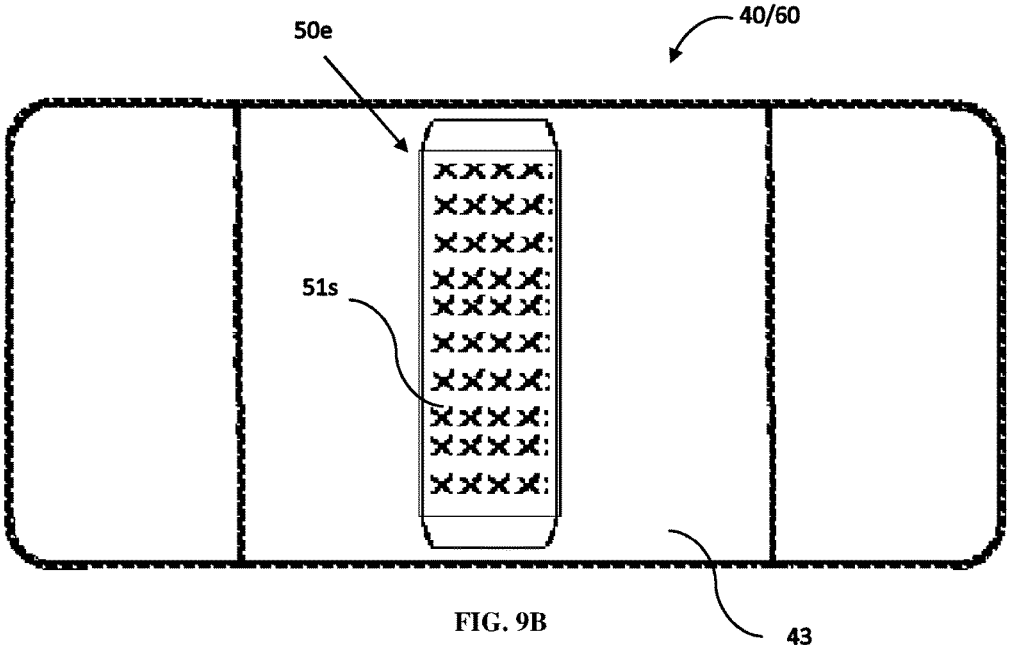
FIG. 9B represents a top portion of the top encasing slot that includes an encasing channel coupled thereon, and encasing a scented strip.
Figure 9C:
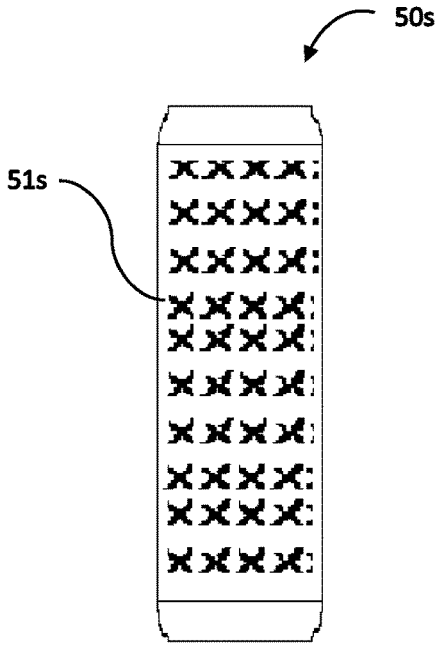
FIG. 9C shows a scented strip.

Alternatively, a scented strip 50 is comprised of a none-adhesive scented strip 51*s* that is used to deodorize a bathroom as shown in FIG. 9C.

In use, the liners 52 are removed and then the tape 50 is applied to the bottom side 41 of the device 40 and to the rim 35 of the toilet bowl 38 as shown in FIGS. 1, 2A, 2B and 3. To remove the tape 50 from the rim 35, a user simply pulls the tab 53 straight back which will release the device 40 from the rim 35.

In use, the attachment material 51 will be suitably configured to attach to porcelain or any other material that toilets are made of There are currently various stretch releasing adhesive tape products sold on the market but these tapes do not adequately attach, fasten or seal to the surface of a toilet, namely to porcelain. One such product currently sold and available on the market is the COMMAND BRAND™ strips. These strips hold firmly on painted walls, finished wood, tile and metal but not to porcelain.

Figure 5:
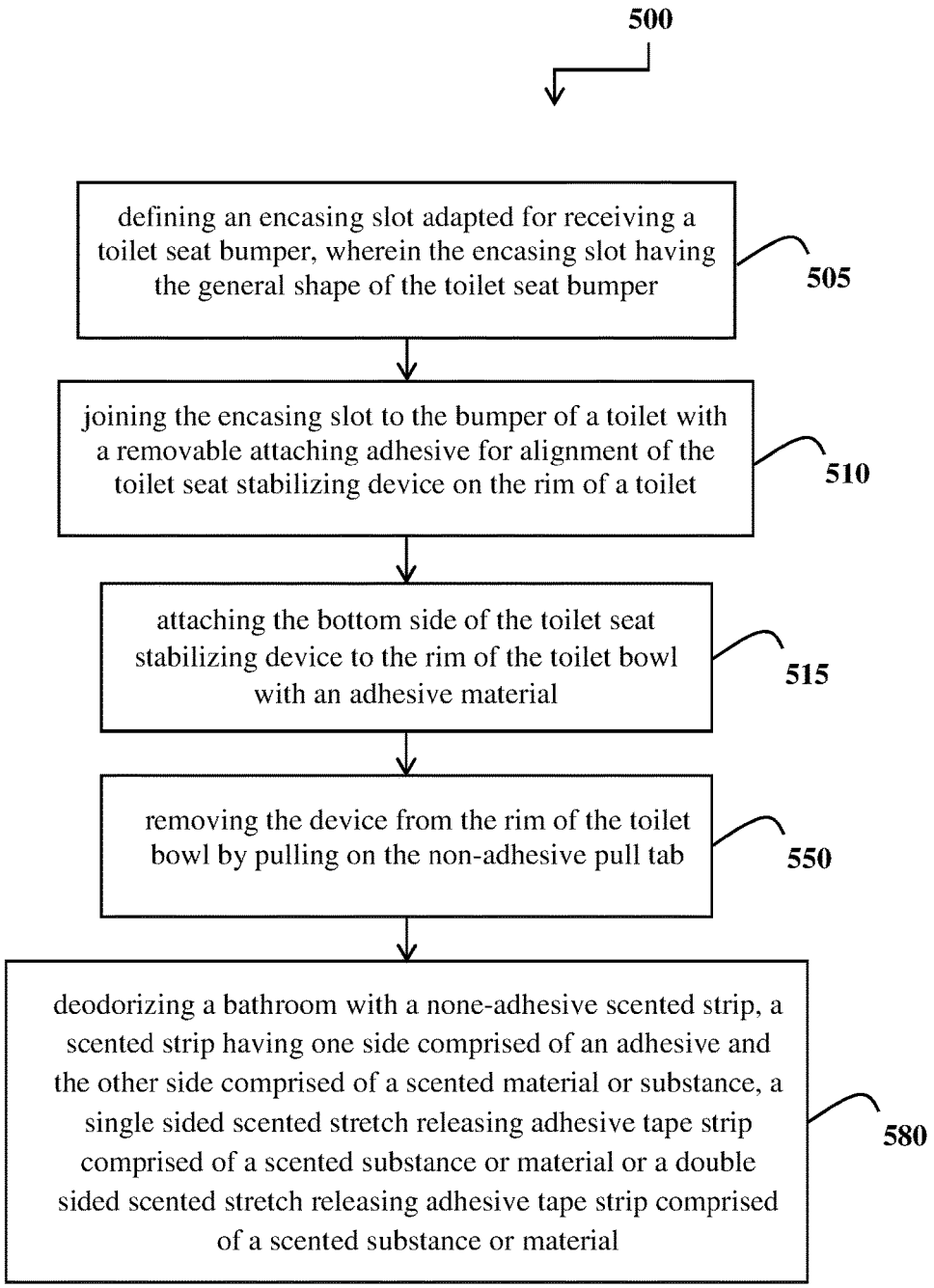
FIG. 5 represents an execution diagram directed to a method of stabilizing a toilet seat with a toilet seat stabilizing device.

FIG. 5 represents an execution diagram for the method 500 of stabilizing a toilet seat with a toilet seat stabilizing device. At block 505, the method comprises the step of defining an encasing slot adapted for receiving a toilet seat bumper, wherein the encasing slot has the general shape of the toilet seat bumper.

At block 510, the method comprises the step of joining or attaching the encasing slot to the bumper of a toilet with a removable attaching adhesive for alignment of the toilet seat stabilizing device on the rim of a toilet.

At block 515, the method comprises the step of attaching the bottom side of the toilet seat stabilizing device to the rim of the toilet bowl with an adhesive material.

At block 550, the method comprises the step of removing the device from the rim of the toilet bowl by pulling on the non-adhesive pull tab.

At block 580, the method comprises the step of deodorizing a bathroom with a none-adhesive scented strip, the scented strip having one side comprised of an adhesive and the other side comprised of a scented material or substance; or a single sided scented stretch releasing adhesive tape strip comprised of a scented substance or material or a double sided scented stretch releasing adhesive tape strip comprised of a scented substance or material.

Figure 6:
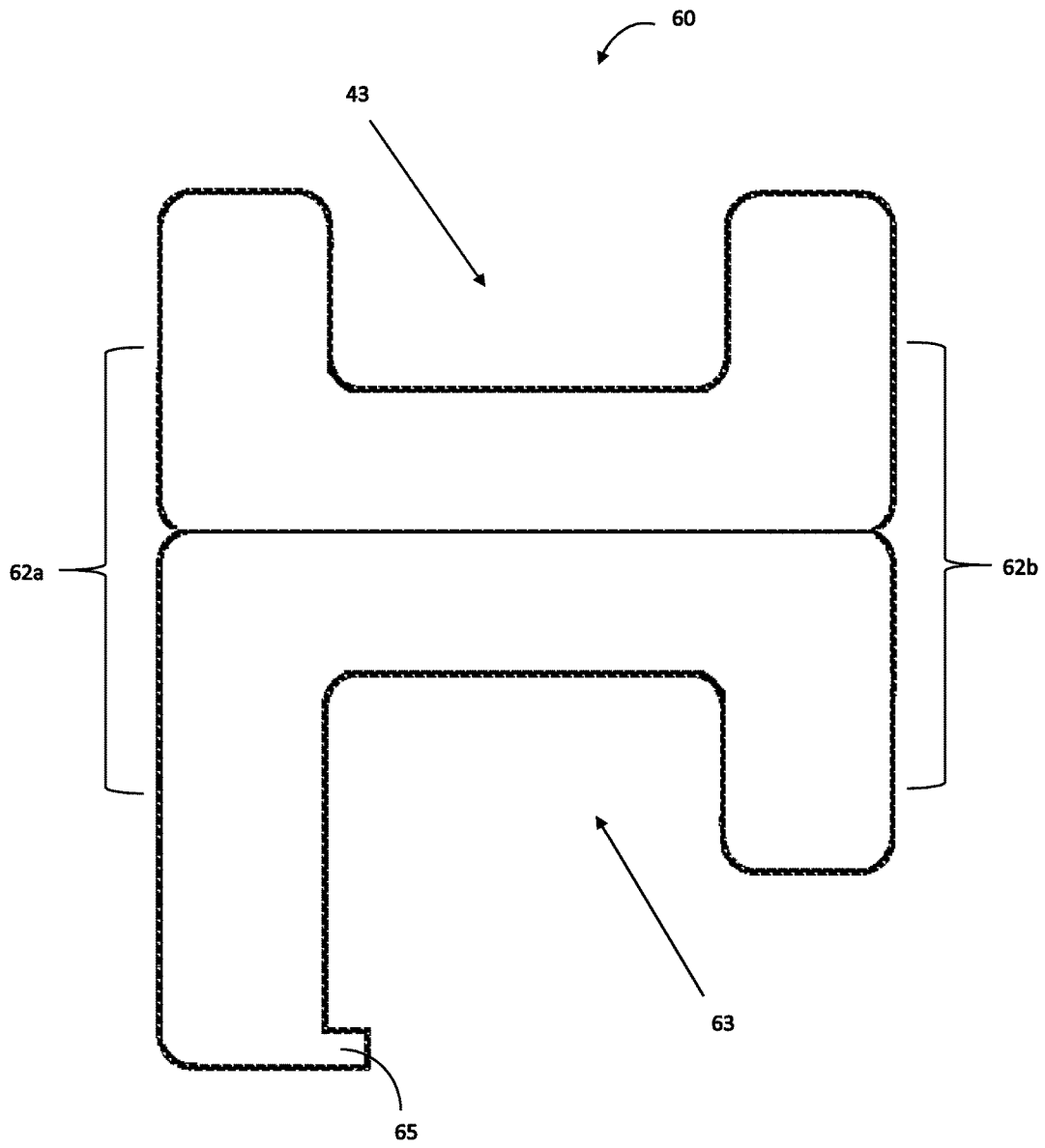
FIG. 6 represents another embodiment of the toilet seat stabilizing device.
Figure 7:
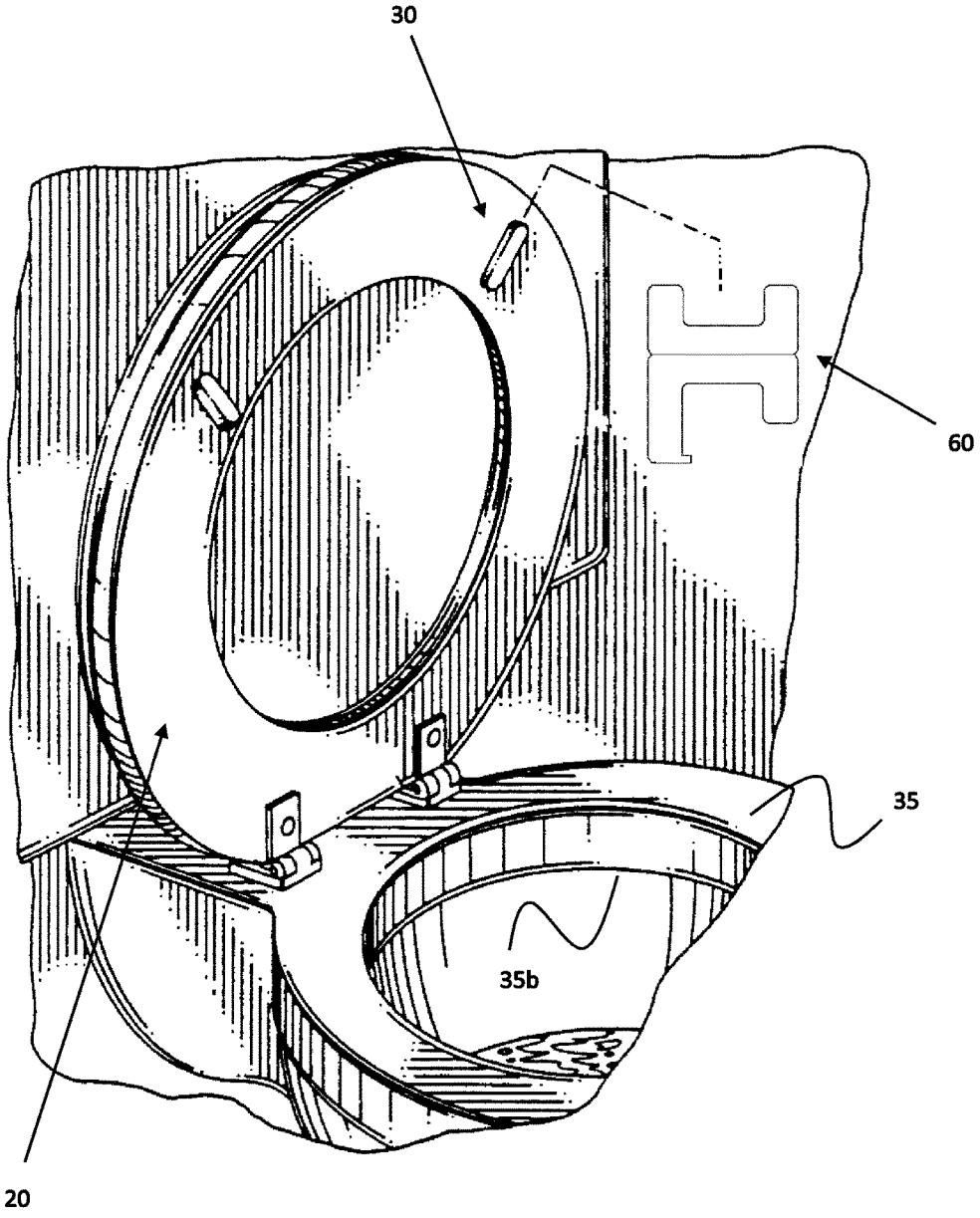
FIG. 7 is another perspective view showing how the toilet seat stabilizing device works in cooperation with the bumper of a toilet seat.

FIGS. 6 and 7 represent another embodiment of the toilet seat stabilizing device 60. The device 60 is comprised of a unitary rigid planar member having a first side wall 62*a* and a second side wall 62*b*, wherein the first side wall 62*a* is longer in length than the second side wall 62*b*. The side walls 62*a*/62*b* define a top encasing slot 43 and a bottom encasing slot 63. The top encasing slot 43 substantially has the general shape of a toilet seat bumper 30 for receiving a toilet seat bumper 30. In use, the top encasing slot 43 is suitably adapted to prevent a toilet seat 20 from sliding back and forth upon the rim 35 of a toilet bowl 38 when a person stands or sits thereon.

Referring still to FIGS. 6 and 7, the bottom encasing slot 63 advantageously includes a toilet rim notch 65 configured to latch to the bottom portion 35*b* of the toilet rim for securing said device 60 to the rim 35 of the toilet bowl 38 (See also FIG. 1). Further, the bottom encasing slot 63 is adapted to have the general shape of a portion of the toilet bowl rim 35, thereby enabling the device 60 to properly encase a portion of the toilet rim 35.

Figure 8A:
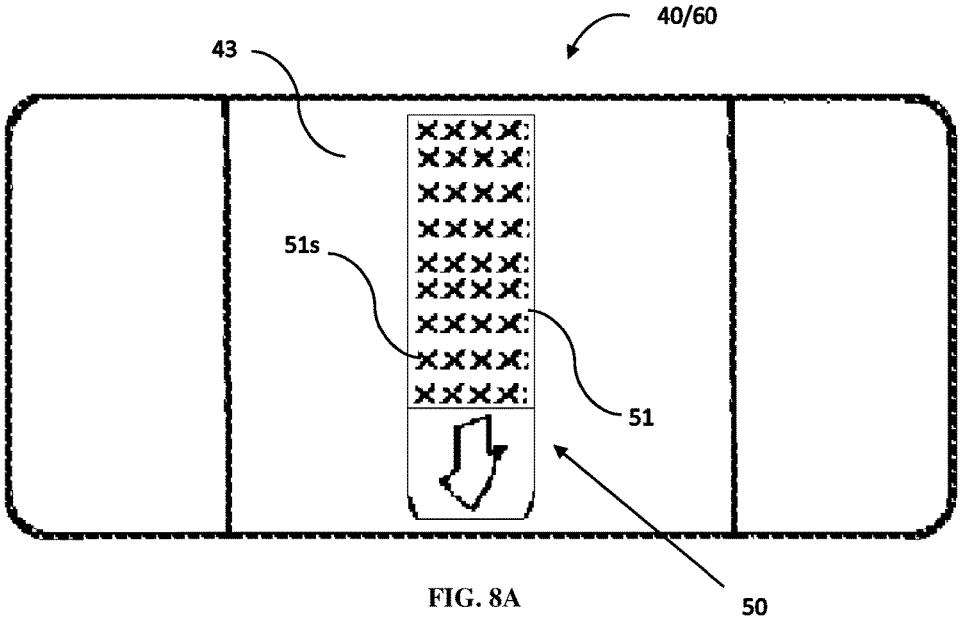
FIG. 8A represents a top portion of the top encasing slot having at least one stretch releasing adhesive tape strip attached thereon.
Figure 8B:
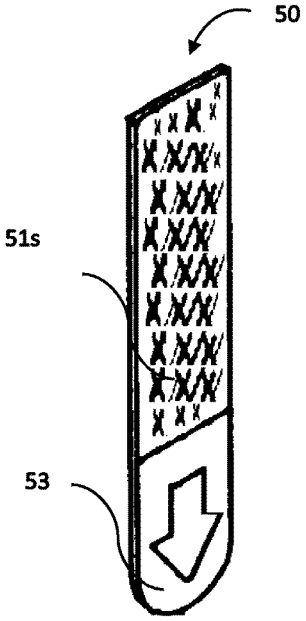
FIG. 8B shows one embodiment of the stretch releasing adhesive tape strip having a scented substance or material disposed thereon.
Figure 8C:
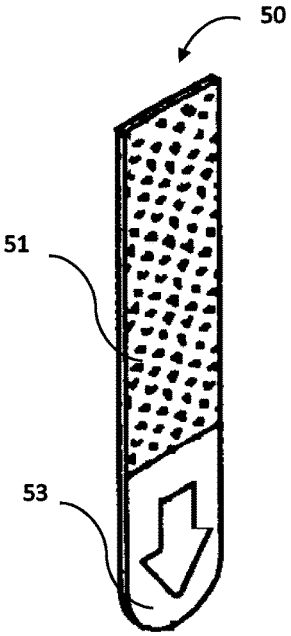
FIG. 8C shows one embodiment of the stretch releasing adhesive tape strip having an adhesive material or substance disposed thereon.
Figure 8D:
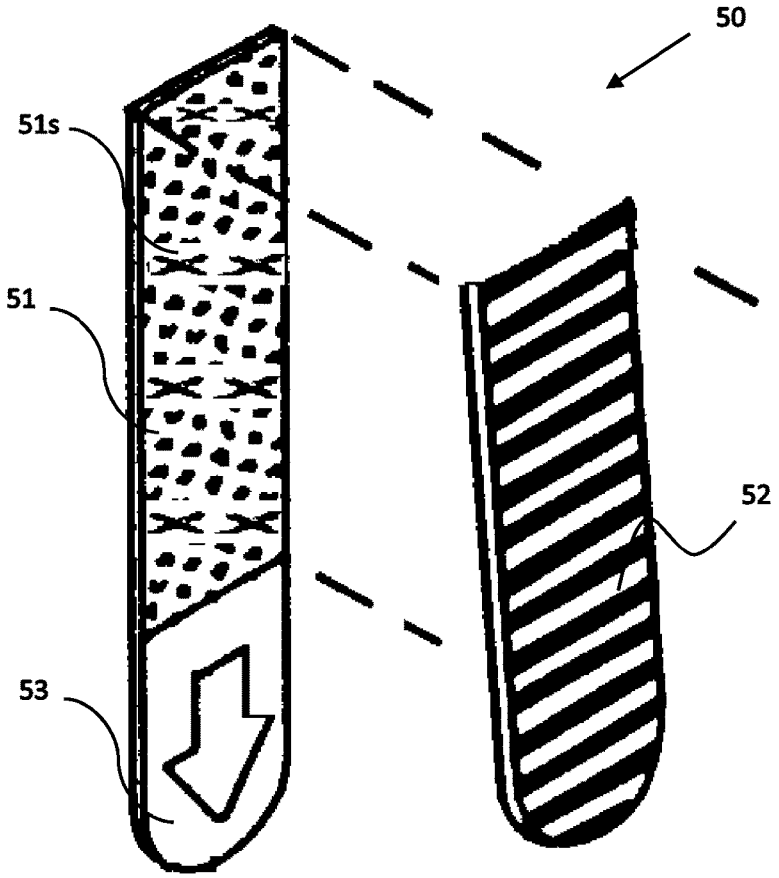
FIG. 8D shows one embodiment of the stretch releasing adhesive tape strip having both a scented and adhesive material and/or substance disposed thereon

In a further embodiment of the present invention, FIG. 8A represents the top encasing slot 43 of the toilet seat stabilizing device 40/60 having at least one tape strip 50 attached thereon. The tape strip 50 also includes a scented material or substance 51*s* disposed and/or infused thereon for deodorizing a bathroom and/or an adhesive substance (See also FIGS. 8B and 8C). In some embodiments, the tape strip 50 includes both the scented material or substance 51*s* and an adhesive material 51 disposed and/or infused thereon (See also FIG. 8D). In use, to remove the deodorizing tape strip 50 from the top surface of the encasing slot 43, a user simply pulls the tab 53 straight back which will release the tape 50 from the slot 43.

Figure 9D:
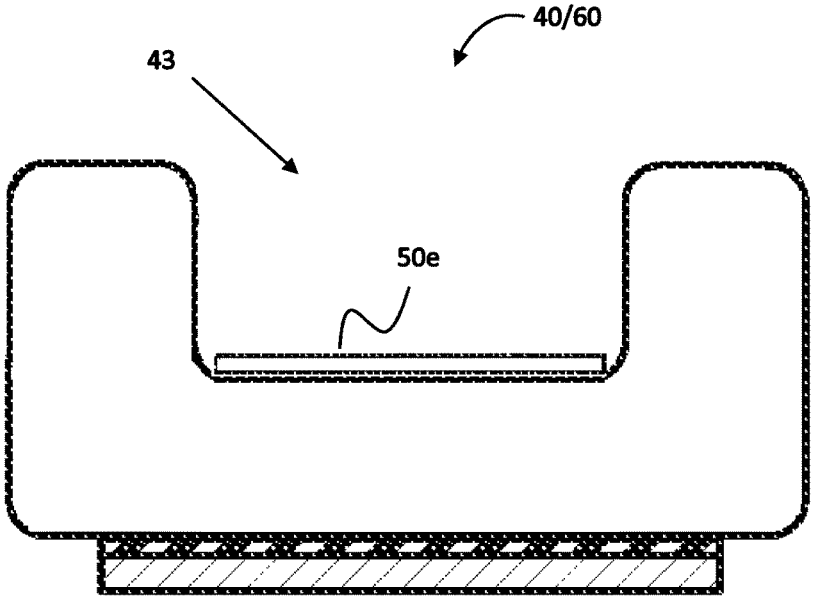
FIG. 9D shows one embodiment of the encasing channel coupled to the top portion of the encasing slot.

In an optional embodiment, FIG. 9A represents the top encasing slot 43 of the toilet seat stabilizing device 40/60. The top portion of the encasing slot 43 includes at least one encasing channel 50*e* coupled thereon for encasing the outer edges of at least one scented strip 50*s* as shown in FIGS. 9B, 9C and 9D. The scented strip 50*s* includes a beneficial scented material or substance 51*s* suitably arranged to deodorize a bathroom (See FIGS. 9B and 9C). The encasing slot 43 of the present invention is made of polypropylene, plastic, die cast plastic, molded plastic, wood, a combination of wood and plastic, wherein the plastic or polypropylene material is rigid, flexible or elastic.

In use, the tape strip 50 and scented strips 50*s* can advantageously serve as a cushion when a toilet lid 20 is accidently slammed or dropped. Also, these strips 50/50*s* are comprised of different colors and/or can have decorative designs. Further, the strips 50/50*s* can be suitably configured to have the general shape of a square, oval, circle or rectangle or simply the shape of a toilet seat bumper 30.

In another embodiment, the material of the tape strip 50 and/or scented strips 50*c* can be impregnated and/or infused with various beneficial fragrance substances and/or materials during manufacture. The strips 50/50*c* can also include microcapsules that release a fragrance when said microcapsules are broken when the removable liner 52 is removed. The strips 50/50*c* can also incorporate therein an effective amount of scent emitting properties for emitting a fragrance to an area such as a bathroom.

It should be understood that the foregoing relates to exemplary embodiments of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future.

INDUSTRIAL APPLICABILITY

The present invention pertains to a deodorizing toilet seat stabilizing device attachable to the top surface of a toilet bowl rim via a stretch release adhesive tape for slide prevention of a toilet seat relative to, and in cooperation with, one or more toilet seat stabilizers which may be of value or importance to various industries such as, but not limited to, the plumbing, bathroom, bathroom accessories & hardware and/or toilet industry.

What is claimed is:

1. A toilet seat stabilizing device comprising:

a unitary rigid planar member having a bottom side and having at least one side wall defining an encasing slot adapted for receiving a toilet seat bumper, wherein the encasing slot substantially having the general shape of the toilet seat bumper;

the encasing slot also having an initial attachment material configured to allow said encasing slot to initially stick to the bumper for alignment of said device on the rim of a toilet;

the encasing slot further adapted to prevent the toilet seat from sliding back and forth upon the rim of the toilet bowl; and an attachment mechanism for securely attaching the bottom side of the device to the rim of the toilet bowl.

2. The toilet seat stabilizing device according to claim 1, wherein said attachment mechanism comprises a stretch releasing adhesive tape strip having an adhesive portion and a non-adhesive pull tab, whereby the adhesive portion being applied to the bottom side of the device and to the rim of the toilet bowel for attaching said device to the rim of the toilet bowl, and whereby the attached device can be removed from the rim of the toilet bowl by pulling on the non-adhesive pull tab.

3. The toilet seat stabilizing device according to claim 2, wherein the stretch releasing adhesive tape strip further includes an aromatic fragrance substance disposed thereon to allow a scent to be released during use.

4. The toilet seat stabilizing device according to claim 1, wherein said device is made of material selected from the group consisting of plastic, die cast plastic, molded plastic, wood, rubber and a combination of wood and plastic, wherein the plastic material is rigid.

5. The toilet seat stabilizing device according to claim 1, wherein the attachment material comprises a glue type material.

6. The toilet seat stabilizing device according to claim 1, wherein the attachment material comprises a hook and loop type fastener.

7. The toilet seat stabilizing device according to claim 1, wherein the attachment material comprises a double sided adhesive tape.

8. The toilet seat stabilizing device according to claim 1, wherein the general shape of the encasing slot is comprised of a square, oval, circle or rectangle.

9. The toilet seat stabilizing device according to claim 1, wherein the initial attachment material comprises a double sided adhesive tape.

10. The toilet seat stabilizing device according to claim 1, wherein the initial attachment material comprises a glue type material.

11. A method of stabilizing a toilet seat with a toilet seat stabilizing device, the method comprising the steps of:

defining an encasing slot adapted for receiving a toilet seat bumper, wherein the encasing slot having the general shape of the toilet seat bumper;

joining the encasing slot to the bumper of a toilet with a removable attaching adhesive for alignment of the toilet seat stabilizing device on the rim of a toilet; and attaching the bottom side of the toilet seat stabilizing device to the rim of the toilet bowl with an adhesive material, thereby preventing the toilet seat from sliding back and forth upon the rim of the toilet bowl.

12. The method of claim 11, wherein the adhesive material comprises a stretch releasing adhesive tape strip having an adhesive portion and a non-adhesive pull tab, and wherein the adhesive portion being applied to the bottom side of the device and to the rim of the toilet bowel for attaching said device to the rim of the toilet bowl.

13. The toilet seat stabilizing device according to claim 12, wherein the attached device can be removed from the rim of the toilet bowl by pulling on the non-adhesive pull tab.

14. A toilet seat stabilizing device comprising:

a unitary rigid planar member having a first side wall and a second side wall, the first side wall being longer in length than the second side wall, wherein the side walls define a top and bottom encasing slot, wherein the top encasing slot substantially having the general shape of a toilet seat bumper for receiving said toilet seat bumper;

the bottom encasing slot having a toilet rim notch configured to latch to the bottom portion of the toilet rim for securing said device to the rim of the toilet bowl, and the bottom encasing slot further having the general shape of a portion of the toilet rim, thereby enabling the device to encase a portion of the toilet bowl rim; and wherein the top encasing slot further adapted to prevent the toilet seat from sliding back and forth upon the rim of said toilet bowl when a person stands or sits thereon.

* * * * *